US005877584A

United States Patent [19]

Kato et al.

[11] Patent Number: 5,877,584

[45] Date of Patent: Mar. 2, 1999

[54] SPARK PLUG FOR AN INTERNAL COMBUSTION ENGINE

[75] Inventors: Tomoaki Kato; Akio Sakura; Takahiro Suzuki, all of Nagoya, Japan

[73] Assignee: NGK Spark Plug Co., Ltd., Nagoya, Japan

[21] Appl. No.: 847,356

[22] Filed: Apr. 24, 1997

[30] Foreign Application Priority Data

Apr. 25, 1996 [JP] Japan ..... 8-105535

[51] Int. Cl.[6] ..... H01T 13/20

[52] U.S. Cl. ..... 313/143; 313/141

[58] Field of Search ..... 313/141, 142, 313/143, 137, 144, 145

[56] References Cited

U.S. PATENT DOCUMENTS

| | | | |
|---|---|---|---|
| 4,700,103 | 10/1987 | Yamaguchi et al. | 313/141 |
| 4,845,400 | 7/1989 | Takamura et al. | 313/142 |
| 5,109,178 | 4/1992 | Yoshida et al. | 313/143 |
| 5,124,612 | 6/1992 | Takamura et al. | 313/141 |
| 5,159,232 | 10/1992 | Sato et al. | 313/141 |
| 5,189,333 | 2/1993 | Kagawa et al. | 313/143 |
| 5,204,579 | 4/1993 | Oshima et al. | 313/143 |

FOREIGN PATENT DOCUMENTS

| | | | |
|---|---|---|---|
| 0 376 147 | 7/1990 | European Pat. Off. | H01T 13/14 |
| 2181383 | 7/1990 | Japan | H01T 13/20 |
| 04 209968 | 7/1992 | Japan | F02P 3/00 |

*Primary Examiner*—Sandra O'Shea
*Assistant Examiner*—Michael Day
*Attorney, Agent, or Firm*—Sughrue, Mion, Zinn, Macpeak & Seas, PLLC

[57] ABSTRACT

In a spark plug, a cylindrical metal shell is provided whose inner wall has a ledge portion on which an insulator rests through its seat portion. The insulator has an axial bore in which a center electrode is placed whose front end has a heat-resistant metal tip. A ground electrode is provided to form a spark gap with the noble metal tip of the center electrode. The insulator forms an insulator nose which measures less than 15 mm in length. The heat-resistant metal tip measures less than 0.8 mm in diameter. A space between an outer surface of the center electrode and an inner wall of a front open end of the axial bore is defined to be more than 0.1 mm in width.

8 Claims, 7 Drawing Sheets

SPARK PLUG FOR AN INTERNAL COMBUSTION ENGINE

BACKGROUND OF THE INVENTION

1. Field of the Invention

The invention relates to a spark plug for an internal combustion engine which is capable of reducing a voltage required to induce spark discharges while reducing carbon-related deposit even when using a shorter insulator nose.

2. Description of Prior Art

In a high compression type engine and a lean burn type engine each recently put into a practical use, the ignitable conditions come to worsen so that remnant of carbon, oil or the like (unburned material) tends to deposit on a front end surface of the insulator so as to induce carbon smoldering in the spark plug. In order to alleviate the carbon smoldering, it has been demanded to effectively remove the unburned material deposited on the front end surface of the insulator to impart a fouling resistant property.

In a spark plug disclosed by a laying-open application No. 2-181383, the carbon deposit on the insulator is burningly removed by subjecting the carbon deposit to inductive spark discharges. That is to say, it is possible to burningly remove the carbon deposit which is exposed to an ionization area of the inductive component among the spark discharges established across the center and ground electrode.

In a spark plug disclosed by U.S. Pat. Nos. 4,845,400 and 5,159,232, the carbon deposit on the insulator is burningly removed by subjecting the carbon deposit to inductive spark discharges in the same manner as described in the laying-open application No. 2-181383.

However, in the laying-open application No. 2-181383, it is necessary to extend the front end of the center electrode by 1.1 mm or less beyond that of the insulator when considering a relationship between a diametrical dimension of the front end of the center electrode and an inner diameter of the axial bore. Furthermore, the front end of the center electrode is likely to be excessively heated for the lack of its heat-drawing effect when heated by the spark discharge energy.

In the reference of U.S. Pat. No. 4,845,400, it is necessary to extend the front end of the center electrode by 1.0 mm or less beyond that of the insulator when considering a relationship between a diametrical dimension of the front end of the center electrode and an inner diameter of the axial bore. Furthermore, the front end of the center electrode is likely to be excessively heated for the lack of its heat-drawing effect when heated by the spark discharge energy.

In the reference of U.S. Pat. No. 5,159,232, it is necessary to define a diameter (d) of the front end of the center electrode as $0.6\ \text{mm} \leqq d \leqq 1.55\ \text{mm}$ when considering a space between the front end of the center electrode and a front open end of the axial bore of the insulator. Furthermore, it is necessary to define how long the front end of the center electrode should extend beyond the insulator.

Therefore, it is a main object of the invention to provide a spark plug which is capable of preventing the carbon smoldering while improving the ignitability with a low voltage required to induce the spark discharges even when an insulator has a shorter insulator nose. This is realized by combining a very thinned front end of the center electrode and a space (referred often to as "air-pocket" hereinafter) between an outer surface of the center electrode and the inner wall of the front open end of the axial bore of the insulator.

SUMMARY OF THE INVENTION

With the heat-resistant metal tip provided on the center electrode to be in a very thinned configuration, it is possible to insure a very rapid electric gradient around the heat-resistant metal tip , and thereby facilitating an ionization around the heat-resistant metal tip to reduce a voltage required to induce spark discharges across the electrodes. With the use of the heat-resistant metal tip provided on the center electrode, it is possible to prevent the spark gap from increasing because it is exposed to high temperature and spark erosion within a combustion chamber. It is noted that the melting point of the heat-resistant metal tip should be higher at least than that of the front end of the center electrode.

With the lower voltage required to induce the spark discharges, it is possible to normally establish the spark discharges across the electrodes when the insulator is carbon smoldered. The carbon smoldering reduces an insulation resistance between the center electrode and the metal shell which is equi-potential to the ground electrode. Due to the reduction of the insulation resistance, the smoldered portion permits a slight amount of electric current to flow between the metal shell and the center electrode during the time period in which the high voltage establishes the spark discharges across the center and ground electrode (spark gap). This reduces the high voltage applied across the spark gap compared to the case in which the insulator is not carbon smoldered. When an actual voltage applied across the spark gap reduces more than the voltage required to normally induce the spark discharges across the spark gap, it always fails to establish the spark discharges across the spark gap.

Consequently, if it is possible to reduce the voltage required to induce the spark discharges, the spark discharge always appear normally across the spark gap even when the insulation resistance has dropped to a greater degree because of the carbon smoldering. By diametrically reducing the front end of the center electrode, it is possible to reduce the flame-extinguishing effect so as to improve the ignitability.

On the other hand, the heat transmitting ability reduces as the diameter of the front end of the center electrode reduces. The reduced heat transmitting ability increases the spark erosion of the heat-resistant metal tip particularly in high temperature.

While running the engine, most part of the heat subjected to the front end of the center electrode is drawn inward the insulator via its seat portion toward the metal shell via its ledge portion to escape to a cylinder head on which the spark plug is mounted. With this in mind, it is possible to facilitate the heat transmission smoothly as the ledge portion is relocated to approach a front portion of the spark plug. This means that the heat of the center electrode is transmitted more rapidly as the insulator nose becomes shorter to reduce the temperature of the front end of the center electrode.

For this reason, it is possible to prevent the heat-resistant tip from becoming excessively heated with a minimum spark erosion by determining the insulator nose to be shorter. On the other hand, the shorter insulator nose tends to be carbon smoldered particularly when the engine is in the lower temperature condition.

While running the engine, the heat of the front end of the insulator is mostly transmitted to the center electrode In the form of radiation heat toward the metal shell via its ledge portion to escape to the cylinder head oh which the spark plug is mounted in the same manner when the front end of the center electrode is subjected to the heat. In this instance, when shielding the radiation heat transmitted toward the center electrode, it is difficult to release the heat retained to the front open end of the insulator. For this reason, it is possible to maintain the front open end of the insulator in higher temperature by enlarging the air-pocket between an outer surface of the center electrode and the inner wall of the front open end of the axial bore of the insulator. This makes it possible to burningly remove the electrically conductive carbon material so as to facilitate the self-cleaning action.

As described before, the heat of the front end of the insulator is mostly transmitted to the center electrode as radiation heat toward the metal shell via its ledge portion to escape to the cylinder head on which the spark plug is mounted. This means that the heat is likely to transmit as the ledge portion approaches the front portion of the spark plug. When running the engine with a high load, the temperature of the front end of the insulator is likely to rise so as to invite preignition. By providing a shorter insulator nose, it is possible to release the heat retained to the front end of the insulator so as to avoid the preignition.

In order to insure this advantage, it is preferable to determine the formula as 0.5 mm≦D1≦0.7 mm in which D1 shows a diameter of the heat-resistant tip. It is also preferable to determine the formula as 0.1 mm≦L≦0.8 mm in which L shows the width of the air-pocket between an outer surface of the center electrode and the inner wall of the front open end of the axial bore. It is further desirable to determine the insulator nose to be less than 15 mm in length.

When the diameter (D1) of the heat-resistant tip is short of 0.5 mm, the metal tip is likely to melt away because the spark discharge energy instantaneously rises the tip even when a shorter insulator nose is provided. However, this situation is avoided by using a metal tip having a higher melting point (more than 1600° C.). As examples of the heat-resistant tip having a melting point of more than 1600° C., it is appropriate to introduce a sintered ceramic which is prepared with iridium and yttria as main components.

When the diameter (D1) of the heat-resistant tip exceeds 0.7 mm, it becomes difficult to reduce the voltage required to induce the spark discharges across the electrodes.

When the width L of the air-pocket is short of 0.1 mm, the heat of the front end of the insulator is likely to escape via the center electrode, and thereby rendering it difficult to keep the front end of the insulator in higher temperature so as to reduce the self-cleaning action because it is difficult to satisfactorily burn the electrically conductive carbon material deposited on the front end of the insulator.

When the width L of the air-pocket exceeds 0.8 mm, it becomes difficult to radiatively transmit the heat of the front end of the insulator to the center electrode, thus likely inviting the preignition at the time of running the engine with a high load.

It is preferable to determine the formula as 0.3 mm≦H≦2.0 mm in which H shows the depth of the air-pocket. When the depth H of the air-pocket is short of 0.3 mm, the heat of the front end of the insulator is likely to escape via the center electrode, and thereby renders it difficult to keep the front end of the insulator in higher temperature so as to reduce the self-cleaning action because it is difficult to satisfactorily burn the electrically conductive carbon material deposited on the front end of the insulator.

When the depth H of the air-pocket exceeds 2.0 mm, it becomes difficult to radiatively transmit the heat of the front end of the insulator to the center electrode, thus likely invites the preignition at the time of running the engine with a high load.

DETAILED DESCRIPTION OF PREFERRED EMBODIMENTS OF THE INVENTION

Figure 1:
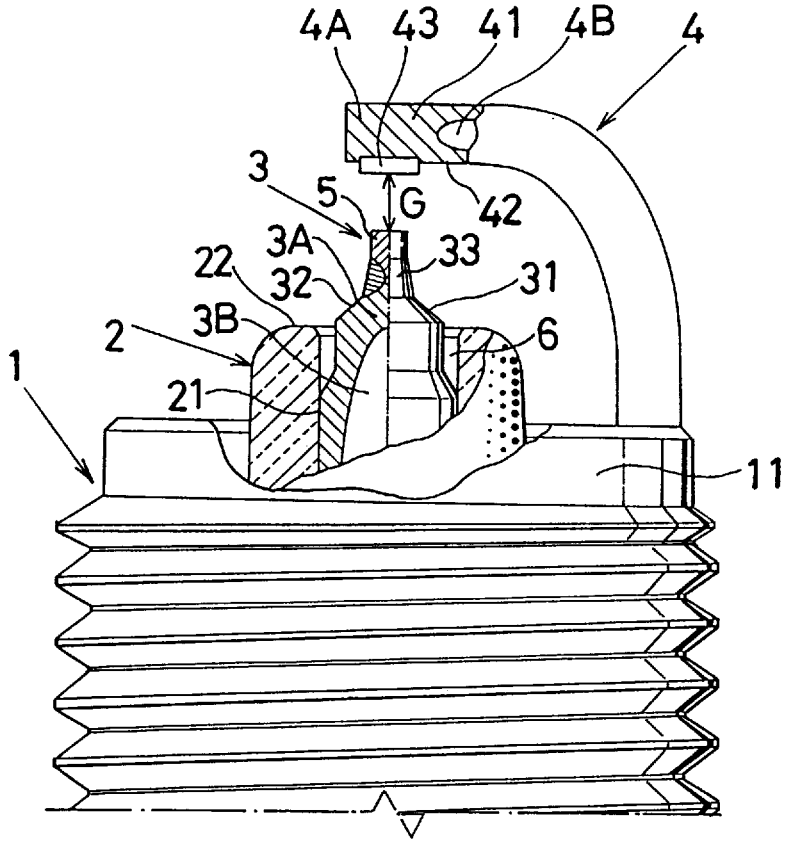
FIG. 1 is an elevational view of a spark plug for an internal combustion engine.
Figure 2:
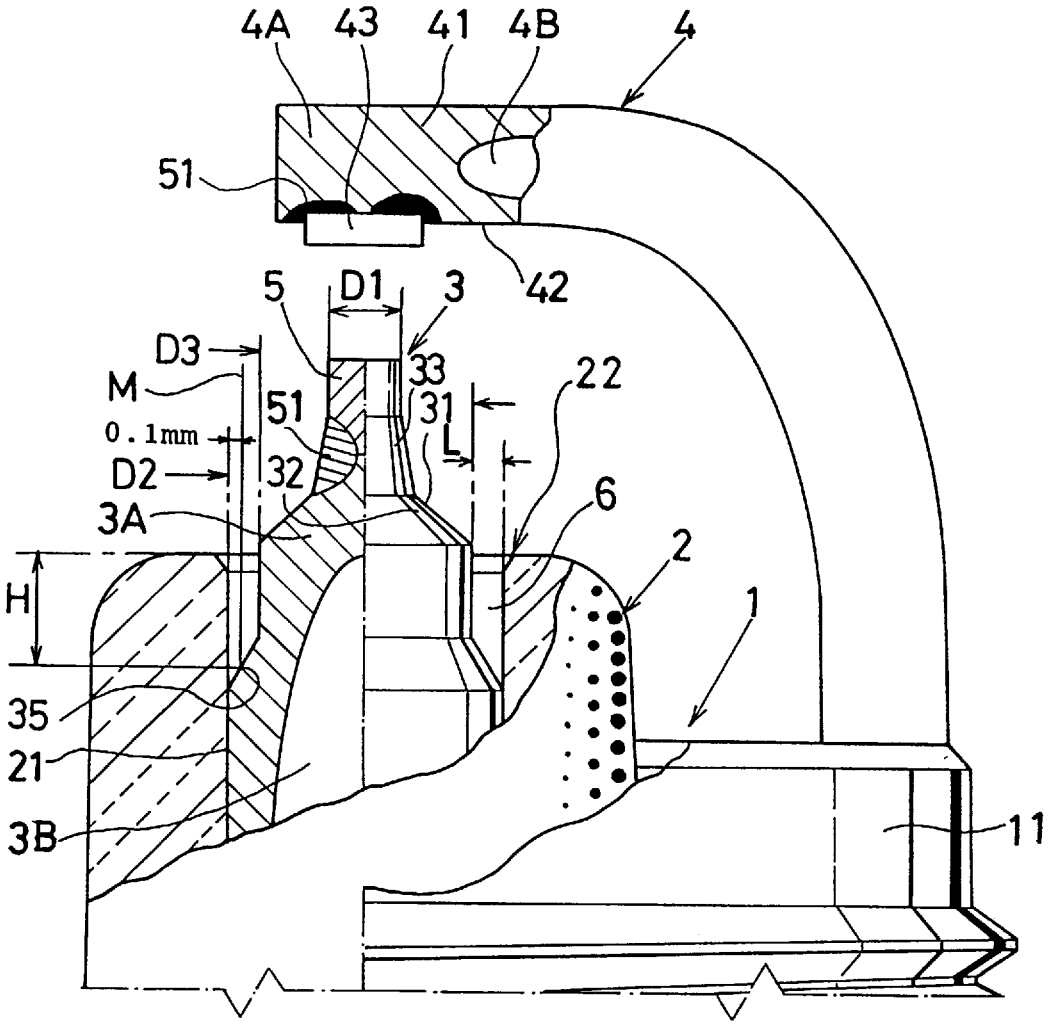
FIG. 2 is an enlarged view of FIG. 1.
Figure 6:
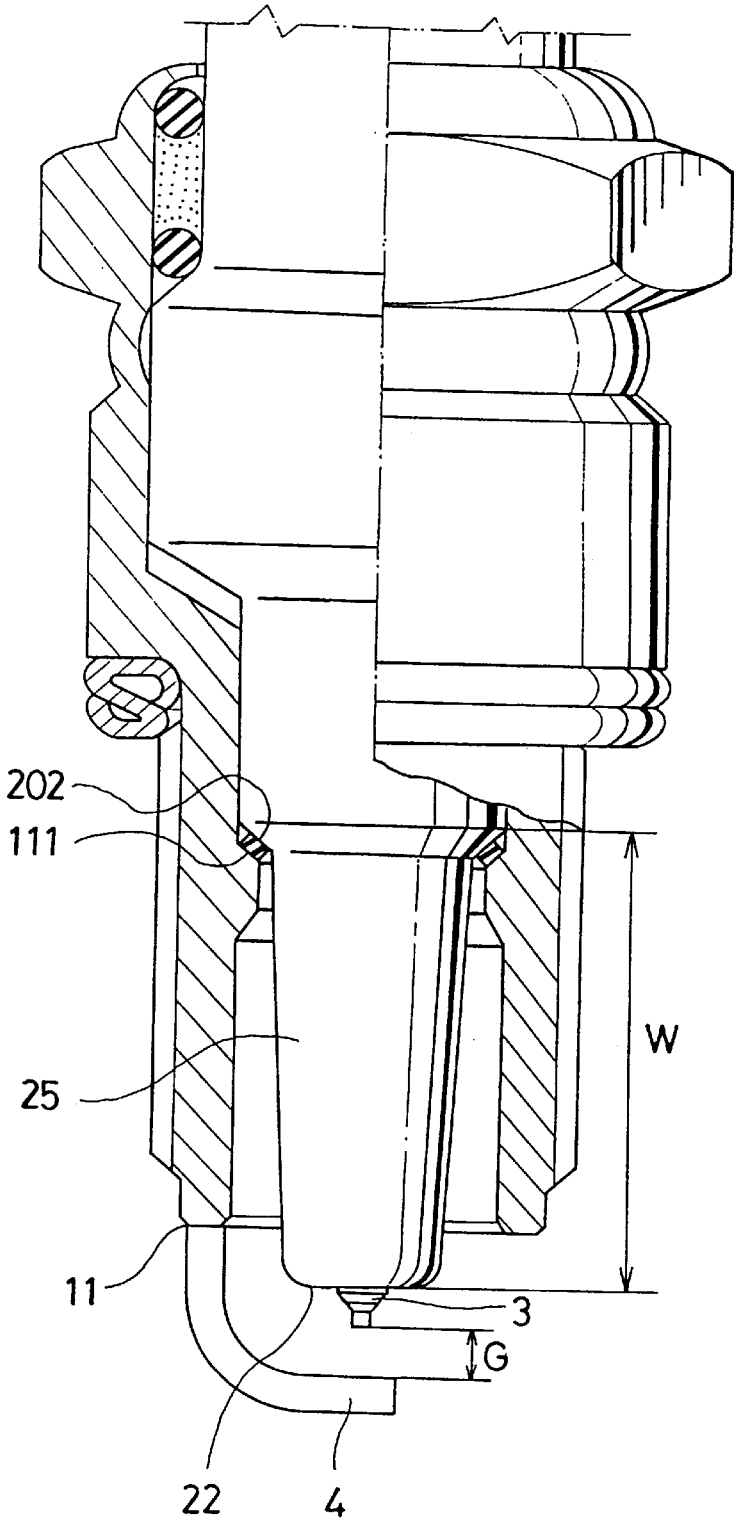
FIG. 6 is an elevational view of an insulator nose of the spark plug for the internal combustion engine.

Referring to FIGS. 1, 2 and 6 which show a front portion of a spark plug for an internal combustion engine according to an embodiment of the invention, the spark plug has a cylindrical metal shell 1 and an insulator 2 provided in the metal shell 1. The insulator 2 has a seat portion 202 which rests on a ledge portion 111 which is provided at an inner wall of the metal shell 1. The insulator 2 has an axial bore 21 in which a center electrode 3 is fixedly placed in the manner to extend its front end 31 beyond a front end surface 22 of the insulator 2. The center electrode 3 is made of a nickel-based clad metal 3A in which a heat-conductive copper core 3B is embedded.

To a front end 11 of the metal shell 1, a ground electrode 4 rectangular in cross section is welded with its front end 41 turned toward the center electrode 3. The ground electrode 4 is made of a nickel-based clad metal 4A in which a heat-conductive copper core 4B is embedded. To the center electrode side 41 in which the front end 41 of the ground electrode 4 opposes the center electrode 3, a platinum-based heat-resistant noble metal tip 43 is welded which is formed into a disc-shape configuration. The noble metal tip 43 forms a spark gap G with a heat-resistant metal tip 5 provided on the front end 31 of the center electrode 3 as described hereinafter.

The front end 31 of the center electrode 3 forms a forward portion of the clad metal 3A, and having a frusto-cone shaped portion 32 (approx. 90 degrees in terms of tapered angle) and a columnar portion (not shown). To a front end surface of the columnar portion, a disc-shaped heat-resistant metal tip 5 is laser welded so as to form a frusto-cone shaped section 33 (approx. 30 degrees in terms of tapered angle) at an interface between the columnar portion and the heat-resistant metal tip 5.

The heat-resistant metal tip 5 is made of a sintered ceramic material with Ir and $Y_2O_3$ as main components. The metal tip 5 measures 0.6 mm±0.05 mm in diameter (D1) and 0.8 mm in length. It is preferable to determine the formula to be 0.5 mm≦D1≦0.7 mm so as to insure a minimum amount of the spark erosion while achieving a low voltage required to induce the spark discharges. The formula of D1≦0.8 mm is acceptable to attain the object the present invention had anticipated.

When making the heat-resistant metal tip 5, 98.3% by weight of iridium powder (2.5 μm in diameter on average) and 1.7% by weight of yttria powder (0.4 μm in diameter on average) are kneaded with an addition of a binder to form a preform body which is thereafter sintered on predetermined conditions.

A melting point of the mixture of Ir and $Y_2O_3$ is 1600° C. or more. When using Ir-Rh based alloy in lieu of the mixture, a melting point of the alloy is 1700° C. or more although the melting point differs according to the containing rate of Ir and Rh.

With the use of the laser welding, the noble metal tip 43 and the heat-resistant metal tip 5 are thermally bonded to the electrode clad metal to solidify an alloyed metal layer 51.

With the adoption of the noble metal tip 43 and the heat-resistant metal tip 5, it is possible to alleviate the spark erosion of the firing portion of the center and ground electrode so as to prolong the service life of the spark plug. When adopting the very thinned firing portion of the center electrode 3 as expressed by the formula of D1≦0.8 mm, it is desirable to predetermine the melting point of the heat-resistant tip 5 to be 1600° C. or more.

The insulator nose 25 measures 11 mm in length (W), and the front open end of the axial bore 21 of the insulator 2 measures 2.6 mm in diameter (D2). A diameter (D3) of the front end 31 of the center electrode 3 surrounded by the front open end of the axial bore 21 measures 2.0 mm.

There is provided an air-pocket 6 in terms of an annular space between an outer surface of the center electrode 3 and an inner wall of the front open end of the axial bore 21. A width (L) and depth (H) of the air-pocket 6 measures 0.3 mm (more than 0.1 mm) and 1.0 mm respectively.

It is preferable to determine the formulas to be in turn W≦15 mm and 0.15 mm≦L≦0.3 mm. When expressing the formula by 0.3 mm≦H≦2.0 mm, it is advantageous to effectively avoid the preignition and carbon smoldering concurrently. The optimum results are attained when representing the formula by 0.3 mm≦H≦1.5 mm.

It is to be observed from FIG. 2 that the depth H of the air-pocket 6 is defined herein by an effective length measured from the front end surface 22 of the insulator 2 to a point 35 In which an extension line M meets a tapered surface of the center electrode 3. The extension line M is distanced by 0.1 mm from the inner wall of the axial bore 21 of the insulator 2.

Figure 7:
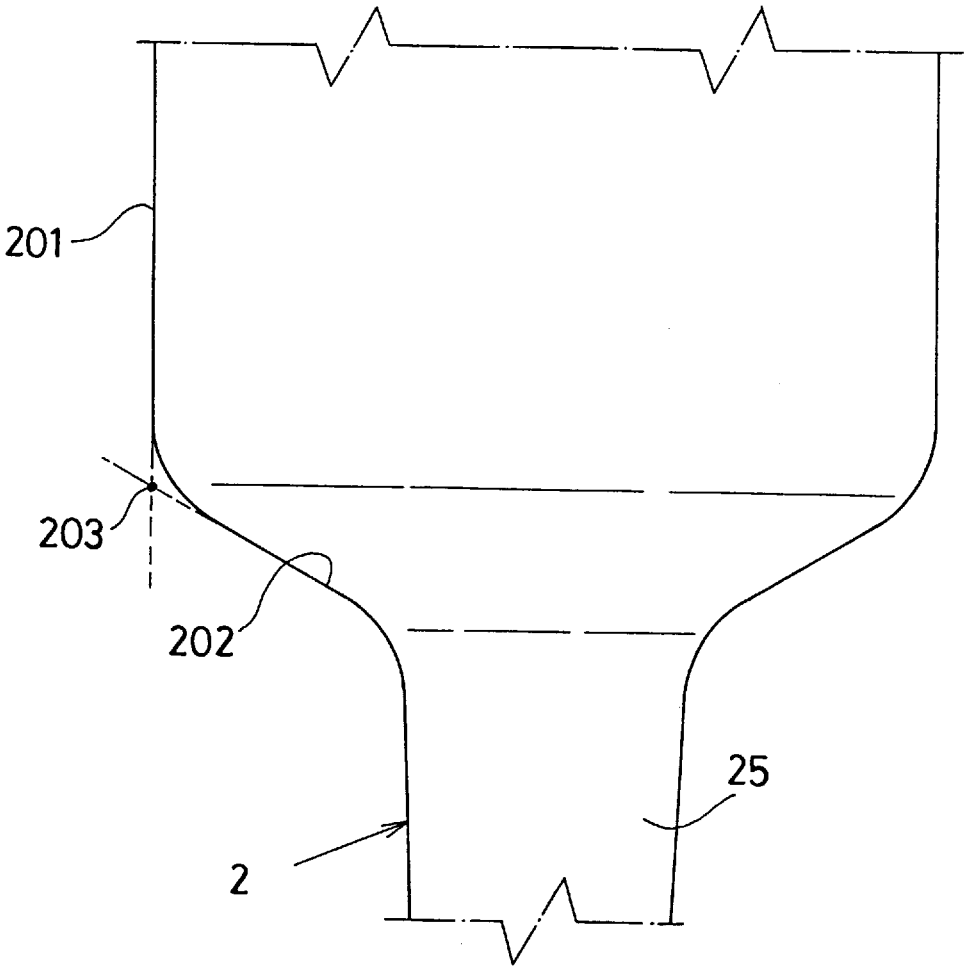
FIG. 7 is an explanatory view of the insulator nose to show an initial point when beginning to measure a length of the insulator nose.

A shown by FIGS. 6, 7, the length W of the insulator nose 25 is defined herein from an intersection 203 of the extension lines along the seat portion 202 and an outer surface of a barrel portion 201 to the front end surface 22 of the insulator 2.

With the structure thus far described, it is possible to significantly reduce the spark erosion and the voltage required to normally induce the spark discharges across the electrodes. With the use of the relatively greater width (L) of the air-pocket 6, it is possible to effectively regulate the heat-drawing action from the front end of the insulator 2 to the front end of the center electrode 3, thus enabling the front end of the insulator 2 to be maintained at higher temperatures so as to readily burn out the carbon-related deposit on the insulator 2 to facilitate the self-cleaning action.

This makes it possible to effectively protect the insulator 2 against the carbon smoldering, and thereby reduces occurrences of misfire due to irregular spark discharges.

On the other hand, the shorter length (W) of the insulator nose 25 compensates for an increase of heat value, that otherwise would invite preignition, due to the regulated thermal transfer from the front end of the insulator 2 to the front end of the center electrode 3.

Figures 3A, 3B, 3C:
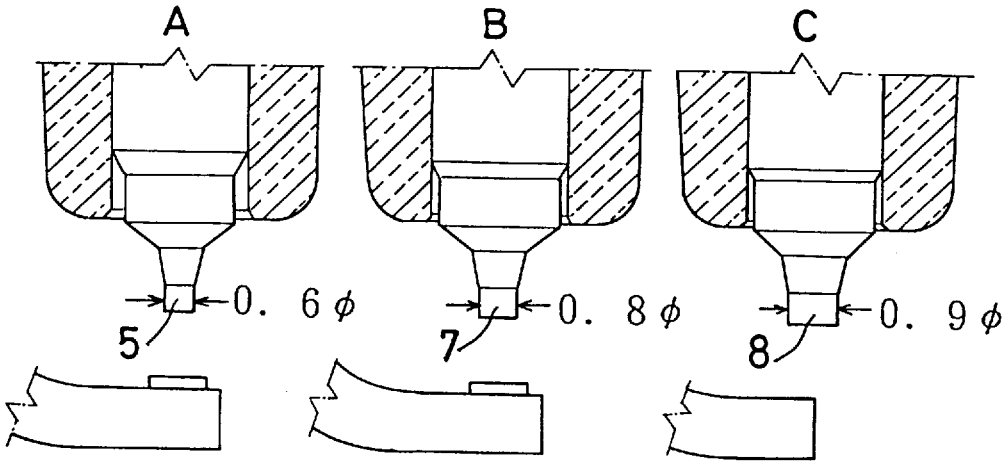
FIGS. 3*a*, 3*b*, 3*c* are cross sectional views representing a heat-resistant tip of different diameter.

As shown by FIGS. 3*a*~3*c*, spark plugs A, B, C are prepared to check the voltage required to induce spark discharges across the electrodes by altering the width of the spark gap G. The spark plug A, which represents the present invention, has the heat-resistant metal tip 5 measured 0.6 mm in diameter. The spark plug B, which represents the prior art counterpart, has an nickel-based alloy tip 7 measured 0.8 mm In diameter. The spark plug C used for racing competition, which also represents the prior art counterpart, has an nickel-based alloy tip 8 measured 0.9 mm in diameter.

Figure 3D:
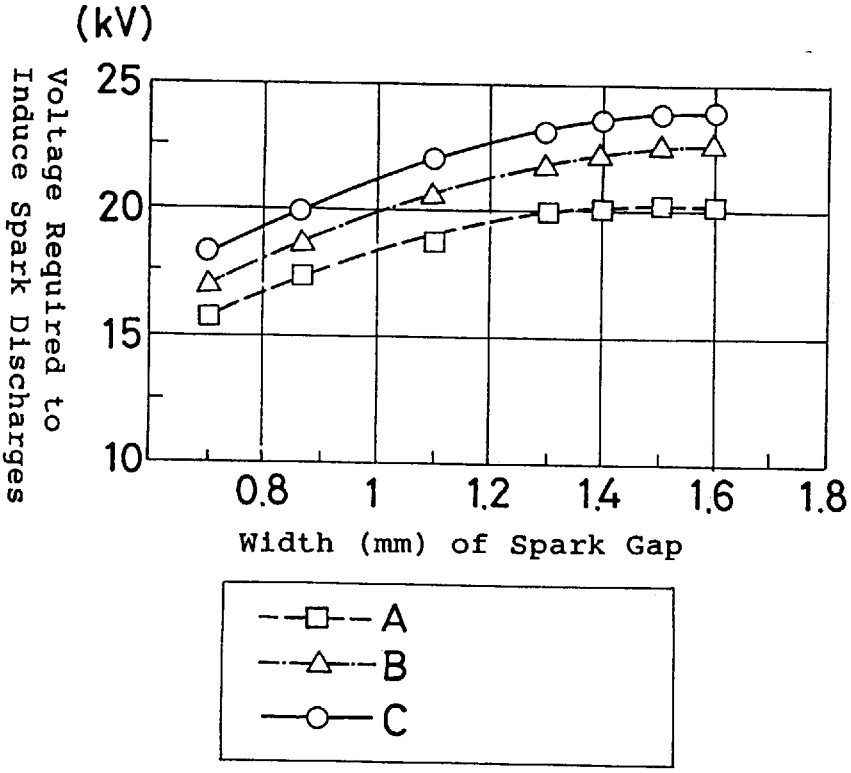
FIG. 3*d* is a graphical representation showing a relationship between a spark gap and a voltage required to induce spark discharges across electrodes.

As apparent from the graphical representation in FIG. 3*d*, it is possible to reduce the voltage required to induce spark discharges by 2~5 kV in the spark plug A according to the present invention.

In the comparable counterparts B, C, the length W of the insulator nose 25 is 11 mm, the diameter D2 of the front open end of the axial bore 21 is 2.6 mm, and the diameter D3 of the front end 31 of the center electrode 3 is 2.5 mm, the width L and the depth H of the air-pocket 6 is in turn 0.05 mm and 1.0 mm.

Figure 4A:
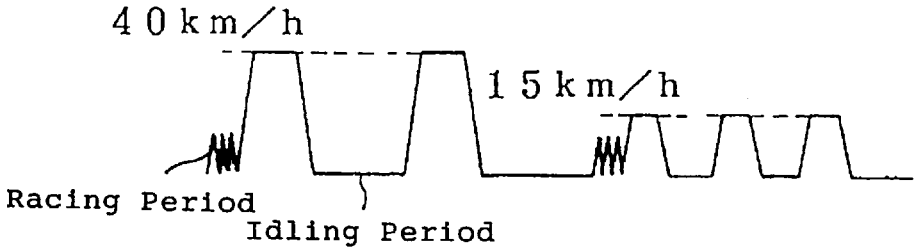
FIG. 4*a* is an operating mode of the internal combustion engine.

An experimental test was carried out with the spark plugs A, B, C in turn mounted on a four-cylinder, 1600 cc engine so as to check the carbon smoldering degree (in terms of insulation resistance) by running the engine ten times repeatedly according to an operating mode in FIG. 4*a*. In this instance, the spark gap G was 0.75 mm uniformly in each of the spark plugs A, B, C.

Figure 4B:
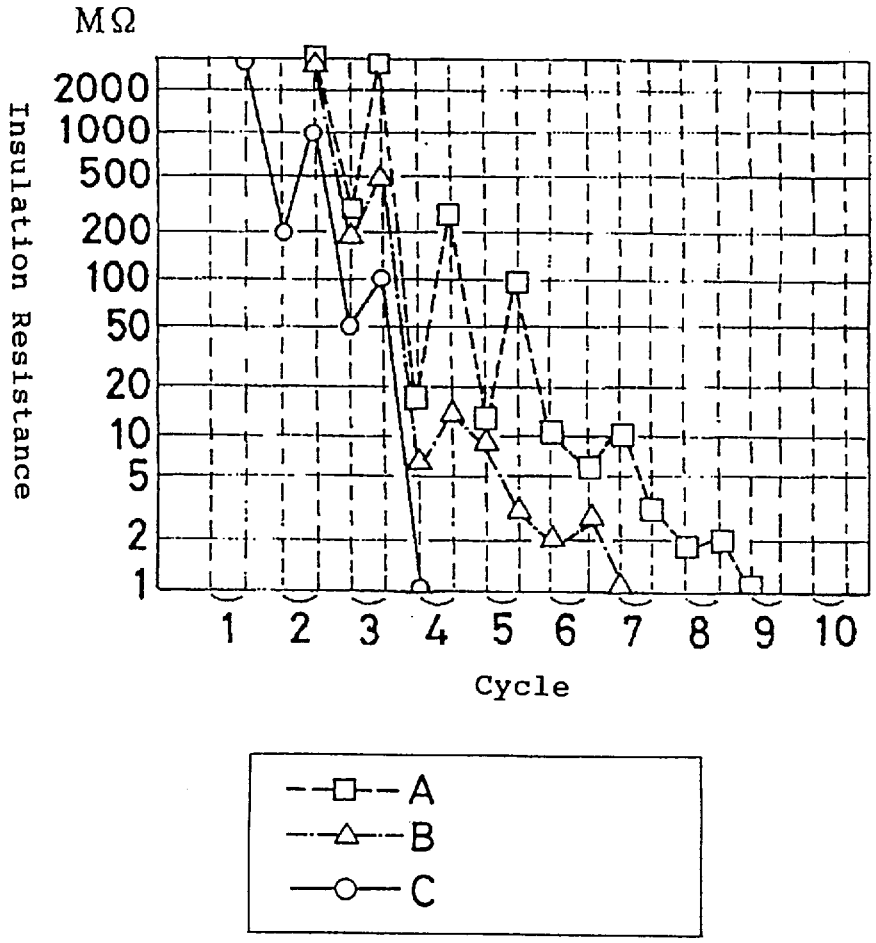
FIG. 4*b* is a graphical representation showing a relationship between the number of cycles and an insulation resistance.

As shown in FIG. 4*b*, it is apparently possible to significantly reduce the carbon smoldering degree in the spark plug A compared to the prior counterparts B, C.

Figure 5A:
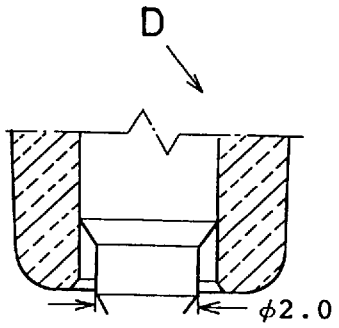
FIGS. 5*a*, 5*b* are partial cross sectional views of front ends of the comparable spark plugs.
Figure 5B:
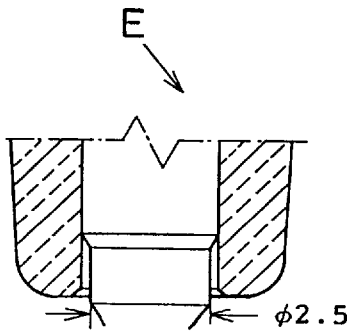

By newly adopting spark plugs D. B (FIGS. 5*a*, 5*b*) instead of the spark plug C, an experimental test was carried out to show a relationship between the length of the insulator nose 25 and the number of cycles in which the insulation resistance drops (FIG. 5*c*) in connection with the spark plugs A, B, D, E.

In the comparable spark plug D, the diameter D2 of the front open end of the axial bore 21 is 2.6 mm, and the diameter D3 of the front end 31 of the center electrode 3 is 2.0 mm, the width L and the depth H of the air-pocket 6 is in turn 0.3 mm and 1.0 mm. In this instance, the center electrode of the spark plug D has no corresponding heat-resistant metal tip, and directly forms the spark gap with the ground electrode while remaining the front end 31 as 2.0 mm in diameter D3.

In the comparable spark plug E, the diameter D2 of the front open end of the axial bore 21 is 2.6 mm, and the diameter D3 of the front end 31 of the center electrode 3 is 2.5 mm, the width L and the depth H of the air-pocket 6 is in turn 0.05 mm and 1.0 mm. In this instance, the center electrode of the spark plug E has no corresponding heat-resistant metal tip, and directly forms the spark gap with the ground electrode while remaining the front end 31 as 2.5 mm in diameter D3.

Upon carrying out the experimental test while running the engine according to the operating mode of FIG. 4*a*, the number of cycles was checked in which the insulation resistance stood at 1 MΩ or less.

Figure 5C:
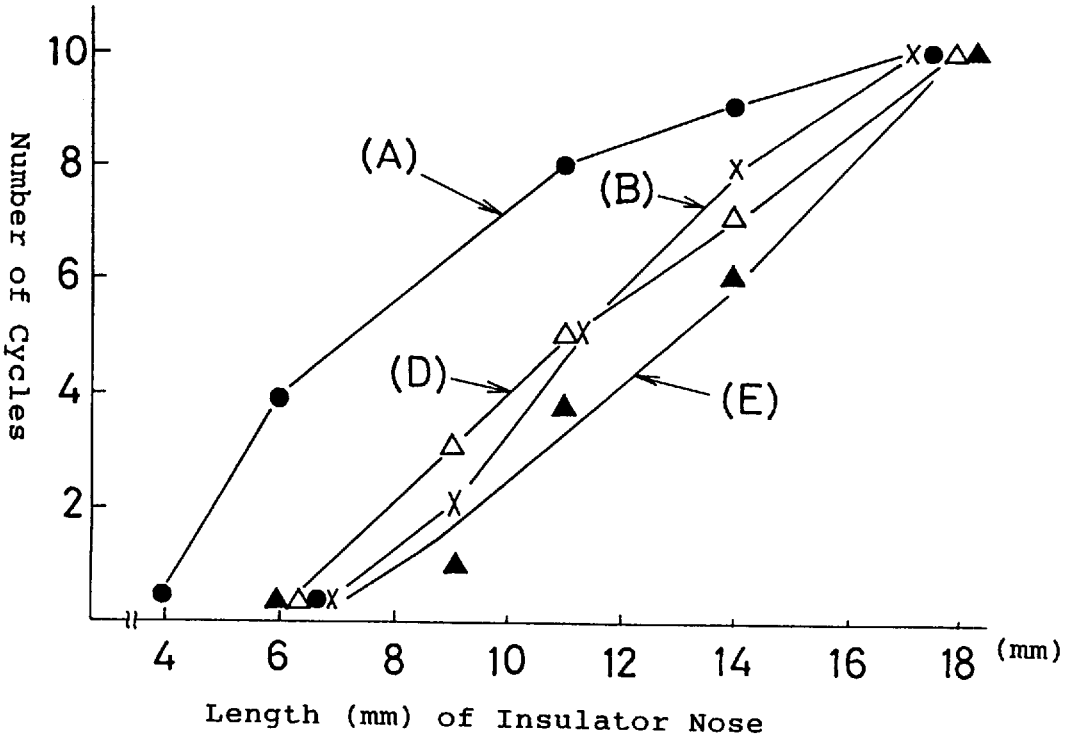
FIG. 5*c* is a graphical representation showing a relationship between the number of cycles and an insulator nose of different length.

In the spark plug A in which the length W of the insulator nose 25 is less than 15 mm, it is possible to maintain the insulation resistance in high values compared to the comparable counterparts B, D, E as shown in FIG. 5*c*. Upon insuring an optimal effect, it is advantageous to determine the length W of the insulator nose 25 to be shorter than 15 mm.

When the length W of the insulator nose 25 is short of 4 mm in which the insulation distance between the center electrode 3 and the ledge portion 111 of the metal shell 1, the insulation resistance drops for a very short period of time upon running the engine according to the operating mode of FIG. 4*a*. With this in mind, it is preferable that the length W of the insulator nose 25 is at least 4 mm.

While the invention has been described with reference to the specific embodiments, it is understood that this description is not to be construed in a limiting sense in as much as various modifications and additions to the specific embodiments may be made by skilled artisans without departing the scope of the invention.

We claim:

1. In a spark plug including a cylindrical metal shell whose inner wall has a ledge portion on which an insulator rests through its seat portion, the insulator having an axial bore in which a center electrode is placed whose front end has a heat-resistant metal tip, and a ground electrode provided to form a spark gap with a noble metal tip of the center electrode;

the spark plug comprising:

the insulator forming an insulator nose which measures less than 15 mm in length;

the heat-resistant metal tip measuring less than 0.8 mm in diameter; and a space between an outer surface of the center electrode and an inner wall of a front open end of the axial bore being not less than 0.1 mm in width L.

2. In a spark plug as recited in claim 1, wherein a dimensional relationship between D1 and L is defined as follows:

$$0.5\ \text{mm} \leqq D1 \leqq 0.17\ \text{mm},$$

$$0.1\ \text{mm} \leqq L \leqq 0.8\ \text{mm},$$

Where D1 is the diameter of the heat-resistant metal tip.

3. In a spark plug as recited in claim 1 or 2, wherein a dimensional relationship is defined as follows:

$$0.3\ \text{mm} \leqq H \leqq 2.0\ \text{mm}.$$

Where H is a depth of the space between the outer surface of the center electrode and the inner wall of the front open end of the axial bore.

4. In a spark plug as recited in claim 3 wherein a melting point of the heat-resistant metal tip is more than 1600° C.

5. In a spark plug as recited in claim 3 wherein the heat-resistant metal tip is made of a sintered ceramic with iridium and yttria as main components.

6. In a spark plug as recited in any of claims 1–2, wherein a melting point of the heat-resistant metal tip is more than 1600° C.

7. In a spark plug as recited in claim 6 wherein the heat-resistant metal tip is made of a sintered ceramic with iridium and yttria as main components.

8. In a spark plug as recited in any of claims 1–2, wherein the heat-resistant metal tip is made of a sintered ceramic with iridium and yttria as main components.

* * * * *

UNITED STATES PATENT AND TRADEMARK OFFICE

CERTIFICATE OF CORRECTION

PATENT NO. : 5,877,584
DATED : March 2, 1999
INVENTOR(S) : Tomoaki KATO, Akio SAKURA and Takahiro SUZUKI It is certified that error appears in the above-identified patent and that said Letters Patent is hereby corrected as shown below:

Column 8, line 5, delete "0.17" and insert --0.7--.

Signed and Sealed this

Twenty-fifth Day of April, 2000

*Attest:*

Q. TODD DICKINSON

*Attesting Officer*

*Director of Patents and Trademarks*